US005735400A

United States Patent [19]

Packard

[11] Patent Number: 5,735,400

[45] Date of Patent: Apr. 7, 1998

[54] PROTECTOR FOR A ROLL OF TAPE

[75] Inventor: Joy A. Packard, Somerset, Wis.

[73] Assignee: Minnesota Mining and Manufacturing Company, St. Paul, Minn.

[21] Appl. No.: 674,304

[22] Filed: Jul. 1, 1996

Related U.S. Application Data

[63] Continuation of Ser. No. 582,171, Jan. 2, 1996, abandoned.

[51] Int. Cl.[6] ..... B65D 85/671

[52] U.S. Cl. ..... 206/408; 206/411; 242/588.6

[58] Field of Search ..... 206/389, 397, 206/408, 411, 413, 415, 416; 242/570, 578, 579, 588, 588.3, 588.6

[56] References Cited

U.S. PATENT DOCUMENTS

| | | | |
|---|---|---|---|
| D. 125,085 | 2/1941 | Jackson . | |
| D. 141,220 | 5/1945 | Preble, Jr. . | |
| D. 164,733 | 10/1951 | Pretzfelder, Jr. . | |
| D. 185,284 | 5/1959 | Hofmann . | |
| 2,275,212 | 3/1942 | Valentine . | |
| 2,295,477 | 9/1942 | Jackson . | |
| 2,295,679 | 9/1942 | Montback . | |
| 2,790,609 | 4/1957 | Hawthorne et al. . | |
| 4,060,444 | 11/1977 | Schweig, Jr. et al. . | |
| 4,700,835 | 10/1987 | Rognsvoog, Jr. | 206/411 |
| 5,090,565 | 2/1992 | Wang | 206/411 |
| 5,154,335 | 10/1992 | Bredow et al. . | |

OTHER PUBLICATIONS

"3M Surgical Tape Sampler, Standards that never vary", brochure, 3M Health Care, 1993.

"3M Micropore™ Surgical Tape, The dependable choice for a gentle, general dressing paper tape.", 2 page brochure, 3M Health Care, 1995.

Engineering Drawings for the Micropore™ Surgical Tape Dispenser illustrated on the back of the 2 page brochure, which dispenser was sold more than one year prior to the filing date of the present application (3 pages).

2 Photographs of a prior art edge protector for use with Smith & Nephew medical tape rolls, which edge protector does not afford rotation of the roll of tape relative to the edge protector.

*Primary Examiner*—Jacob K. Ackun

*Attorney, Agent, or Firm*—Gary L. Griswold; Walter N. Kirn; Jeffrey J. Hohenshell

[57] ABSTRACT

A one-piece edge protector for a roll of tape is described. The protector has a pair of sides and transverse, peripheral bridge portion which may receive a leading portion of a roll of tape to assist in dispensing the tape. The protector is particularly suitable to protect a roll of hand tearable medical tape.

20 Claims, 5 Drawing Sheets

PROTECTOR FOR A ROLL OF TAPE

This is a continuation of U.S. patent application Ser. No. 08/582,171 which was filed Jan. 2, 1996 and now abandoned.

TECHNICAL FIELD

The present invention is directed to a protector for a roll of tape, and more particularly to a one-piece protector for a roll of manually tearable medical tape.

BACKGROUND

FIGS. 1 and 2 illustrate a typical, prior art roll of tape 1. The tape roll 1 typically has a length of tape wound about a core 8. The core 8 has an inner diameter ID. The length of tape includes a backing B with a pressure-sensitive adhesive 2 coated on at least portions of at least one side of the backing B. When in roll form, the tape has a leading end portion 9. The tape roll 1 includes a pair of sides 3 and 5, a pair of edges 4 and 6, a width W and an outer peripheral surface 7 defining an outer diameter D.

The art is replete with different types of tape rolls designed for a multitude of uses. One type of tape is known in the art as medical tape. As used herein, the phrase "medical tape" means a tape which is designed for use in the health care field. Examples of medical tapes include a) Transpore™ Surgical Tape which is a transparent, easy-to-tear, perforated plastic tape for securing dressings or devices, b) Micropore™ Surgical Tape which is a gentle, general purpose paper tape, c) Durapore™ Surgical Tape which is a cloth tape with strong adhesion for securing dressings or devices, d) Microfoam™ Surgical Tape which is a highly conformable elastic foam tape for compression applications or securing dressings on difficult or challenging areas, and e) Blenderm™ Surgical Tape which is an occlusive, transparent plastic tape that protects wounds from fluids and contaminants. Each of these particular examples of medical tapes is available from Minnesota Mining and Manufacturing Co. (3M) of St. Paul, Minn.

A number of problems are associated with the use of a roll of tape. Many persons may find it difficult or inconvenient to locate the leading end portion 9 of the tape. Often the leading end portion 9 is adhered to the rest of the tape roll 1 making the leading end 10 difficult to find.

Adhesive along the sides 3 and 5 of the roll of tape tends to accumulate dust, dirt and other contaminants. This is particularly a problem for rolls of medical tape which should be kept as clean as possible. The leading end portion 9 of the tape is often wasted when a user elects to simply dispose of the exposed leading end portion 9 in favor of a more pristine portion of the tape. Exposed adhesive along the leading end portion 9 and adhesive along the sides 3 and 5 of the tape tend to stick to clothing or other surfaces which may contaminate the surface and make use of a tape roll 1 inconvenient.

Another problem associated with the use of a roll of tape is that some tape rolls may become easily damaged or altered. It is generally desirable to protect the tape roll (particularly the edges) from scuffs, mars, indentations or other deformations as such deformations may adversely affect the performance of the tape.

Dispensers have been developed over the years to address the problems associated with the use of tape rolls. Many of these dispensers are complex, relatively expensive devices that can be difficult to manufacture.

The art is replete with tape roll dispensers or other devices which include serrations, teeth, blades, tearing edges or other cutting means designed to help separate a leading end portion of a roll of tape from the remaining tape on the roll. Examples of such devices are disclosed in U.S. Pat. Nos. 2,295,679 (Montbach), 2,295,477 (Jackson), 2,790,609 (Hawthorne), 4,060,444 (Schweig, Jr. et al.), Des. 141,220 (Preble), Des. 164,733 (Pretzfelder), Des. 125,085 (Jackson), and Des. 185,284 (Hofmann). Another example of a dispenser with a cutting means comprises the dispenser for use with Micropore™ Surgical Tape. That dispenser has been on sale more than one year prior to the filing date of the present application.

For a roll of manual or hand tearable tape, a cutting means may be unnecessary. A dispenser with a cutting means may also be undesirable in some situations. Cutting means have the potential to scratch or otherwise damage surfaces (e.g. clothing). Cutting means may also cause the dispenser to snag on surfaces which may reduce the convenience for the user. Generally, cutting means also add cost to the dispenser and complicate the manufacturing process.

The prior art also includes an edge protector for use with a roll of medical tape sold by Smith and Nephew. That edge protector comprises two separate pieces which are releasably attached to respective sides of the core 8 of the tape roll. The edge protector does not allow the roll of tape 1 to rotate relative to the edge protector which may adversely affect the ease with which the tape may be dispensed for some users. The edge protector also lacks any surface radially above the outer peripheral surface of the tape which may be utilized to receive a leading end portion of the tape.

BRIEF DESCRIPTION OF THE INVENTION

In one aspect, the present invention comprises a protector for a roll of tape. The roll of tape has a leading end portion of tape, a pair of sides and edges, a width, an outer peripheral surface defining an outer diameter, and a core defining an inner diameter. While the protector is particularly suitable for a roll of hand tearable, medical tape, the protector may also be utilized with other types of tapes.

The protector comprises a first side portion comprising a first side wall having an outer periphery with a substantially circular portion defining an outer diameter which is at least as large as the outer diameter of the roll of tape, and a first hub portion. A second side portion is present comprising a second side wall adapted to be placed substantially opposite the first side wall. The second side wall has an outer periphery having a substantially circular portion defining an outer diameter which is at least as large as the outer diameter of the roll of tape. A second hub portion is also present in the second portion. Preferably, the outer periphery of the first side wall is substantially the same shape as the outer periphery of the second side wall, and the diameter of the first side wall is approximately equal to the diameter of the second side wall.

The protector has a releasable hub means for releasably attaching the first hub portion to the second hub portion to form a hub adapted to receive the roll of tape. The resulting hub has an axis and an outer hub diameter that is sized and shaped to afford free rotation of the roll of tape about the hub. The hub is adapted to receive the roll of tape in one of either a) a first orientation which affords clockwise rotation of the roll of tape about the axis of the hub, or b) a second orientation which affords counterclockwise rotation of the roll of tape about the axis of the hub. Preferably, the outer hub diameter is less than the inner diameter of the core of the roll of tape to afford free rotation of the roll of tape about the hub.

More preferably, the releasable hub means comprises one of the first and second hub portions having a socket portion and the other of the first and second hub portions having a protruding portion adapted to be received in the socket portion in an interference or snap fit. Also preferably, the protector includes stabilizing means for restricting rotation of the first side portion relative to the second side portion. For example, the stabilizing means may comprise one of the first and second hub portions having a key and the other of the first and second hub portions having a slot adapted to receive the key when the releasable hub means forms the hub. The key and slot are situated to resist rotation of the first side portion relative to the second side portion.

A transverse, peripheral bridge portion extends between outer peripheries of the first and second side walls. The peripheral bridge portion has a pair of edges and a tape anchoring surface extending therebetween. The tape anchoring surface is sized and shaped to have the leading end portion of the tape adhered thereto when the roll of tape is mounted in either the first or the second orientation. Preferably, the edges of the peripheral bridge portion are opposite arcuate edges that are sized and shaped to engage a user's digit to assist a user in removing the leading end portion of the tape from the tape anchoring surface.

The outer peripheries of the first and second side walls are free of any portions extending therebetween other than the peripheral bridge portion to provide an opening for access to the outer peripheral surface of the roll of tape. This feature adds a degree of convenience to the protector to help a user dispense a preselected length of tape from the roll as it affords easier access to the leading end portion of the tape. Preferably, the protector is free of any teeth or serrations for cutting the tape with the attendant disadvantages associated with such teeth or serrations.

In order to afford dispensing of the tape from either the first or the second orientation, the protector preferably includes a first hinge between the bridge portion and the first side portion and a second hinge between the bridge portion and the second side portion. The first and second hinges afford movement of the releasable hub means between: (1) a core accept position, and (2) a hub position. In the core accept position, the first hub portion is spaced from the second hub portion to afford removal or replacement of a roll of tape on the hub. In the hub position, the first hub portion is attached to the second hub portion to form the hub.

The protector is constructed from an inexpensive plastic material selected from the group consisting of polystyrene, polyethylene, polypropylene and polycarbonate. Preferably, the protector is a one-piece part which promotes ease of assembly and construction, and inventory simplification and reduction.

In another aspect, the present invention comprises a method of protecting a roll of tape having a leading end portion of tape, a pair of sides and edges, a width, an outer peripheral surface defining an outer diameter, and a core defining an inner diameter. The method comprises the steps of: 1) providing a protector comprising: i) a first side portion comprising a first side wall having an outer periphery, and a first hub portion, ii) a second side portion comprising a second side wall having an outer periphery, and a second hub portion, and iii) a transverse, peripheral bridge portion extending between the outer peripheries of the first and second side walls, the peripheral bridge portion having a pair of opposite edges and a tape anchoring surface extending therebetween, the tape anchoring surface being sized and shaped to have the leading end portion of the tape adhered thereto, the outer peripheries of the first and second side walls being free of any portions extending therebetween other than the peripheral bridge portion to provide an opening for access to the outer peripheral surface of the roll of tape, and with the protector being free of any teeth or serrations for cutting the tape; 2) placing the roll of tape between the first and second hub portions; and 3) releasably attaching the first hub portion to the second hub portion to form a hub which receives the roll of tape.

BRIEF DESCRIPTION OF THE DRAWINGS

The present invention will be further described with reference to the accompanying drawing wherein like reference numerals refer to like parts in the several views, and wherein.

DETAILED DESCRIPTION OF THE PREFERRED EMBODIMENT

Figure 1:
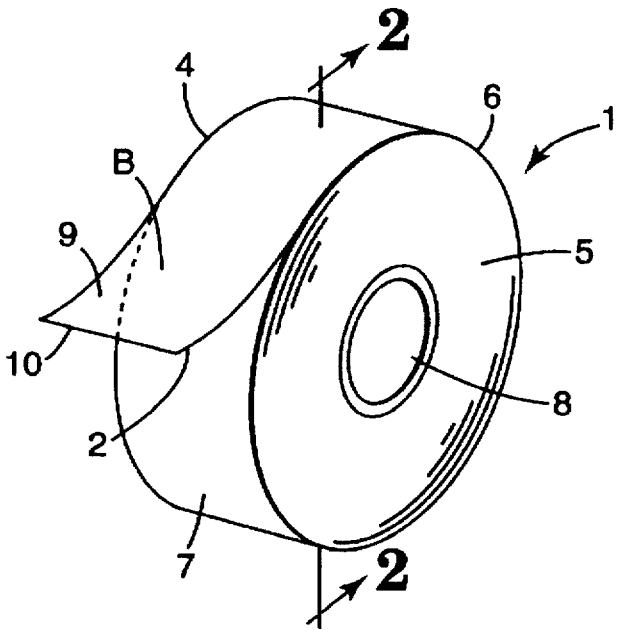
Fig. 1 PRIOR ART
FIG. 1 is a perspective view of a prior art roll of tape.
Figure 2:
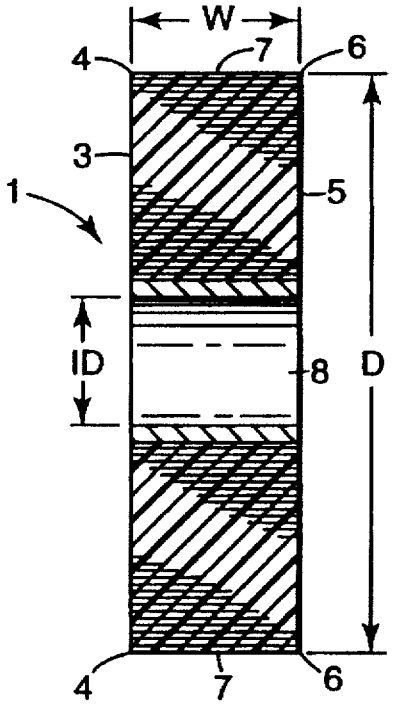
Fig. 2 PRIOR ART
FIG. 2 is a sectional view of the roll of tape of FIG. 1, taken approximately along lines 2—2 of FIG. 1.

Referring now to FIGS. 3 through 11 of the drawing there is shown a protector according to the present invention generally designated by reference character 12. While the protector 12 is suitable for protecting or dispensing almost any type or style of tape roll 1, it is particularly suitable for protecting and dispensing a roll of manually tearable, medical tape. Examples of such manually tearable medical tape include: a) Transpore™ Surgical Tape, b) Micropore™ Surgical Tape, c) Durapore™ Surgical Tape, d) Microfoam™ Surgical Tape, and e) Blenderm™ Surgical Tape; each of which is available from Minnesota Mining and Manufacturing Co. (3M) of St. Paul, Minn. As used herein, the phrases "hand tearable tape" or "manually tearable tape" mean a tape that may be separated or torn apart by a person of ordinary strength and coordination. A variety of factors may render a tape manually or hand tearable. For example, the tape backing may be constructed from a readily tearable material such as paper, cloth or a nonwoven material such as rayon. Perforations, edge geometries, or other alterations of the tape backing B may also render the tape manually or hand tearable.

The protector 12 comprises a first side portion having a first side wall 14 with an outer periphery 15. Preferably, the outer periphery 15 has a substantially circular portion defining an outer diameter OD1. More preferably, the outer diameter OD1 is at least as large as the outer diameter D of the roll of tape 1 so that the first side wall 14 completely covers the roll of tape 1, as opposed to some prior art tape dispensers which leave a portion of the roll of tape (e.g. portions of its side or edge) exposed to potential damage or contamination. An example of such a prior art dispenser is shown in U.S. Pat. No. 4,060,444. The first side portion also has a first hub portion 18. Preferably, the first side portion has a strengthening boss or rib 17.

Figure 3:
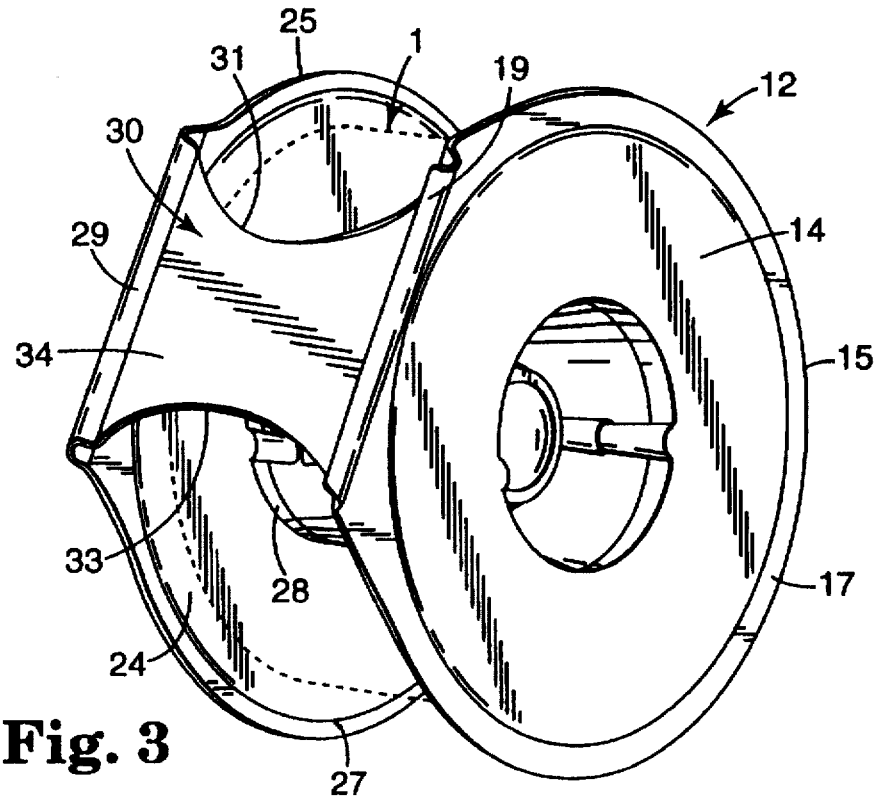
FIG. 3 is a perspective view of a protector for a roll of tape according to the present invasion with dashed lines illustrating a roll of tape placed in the protector.
Figure 11:
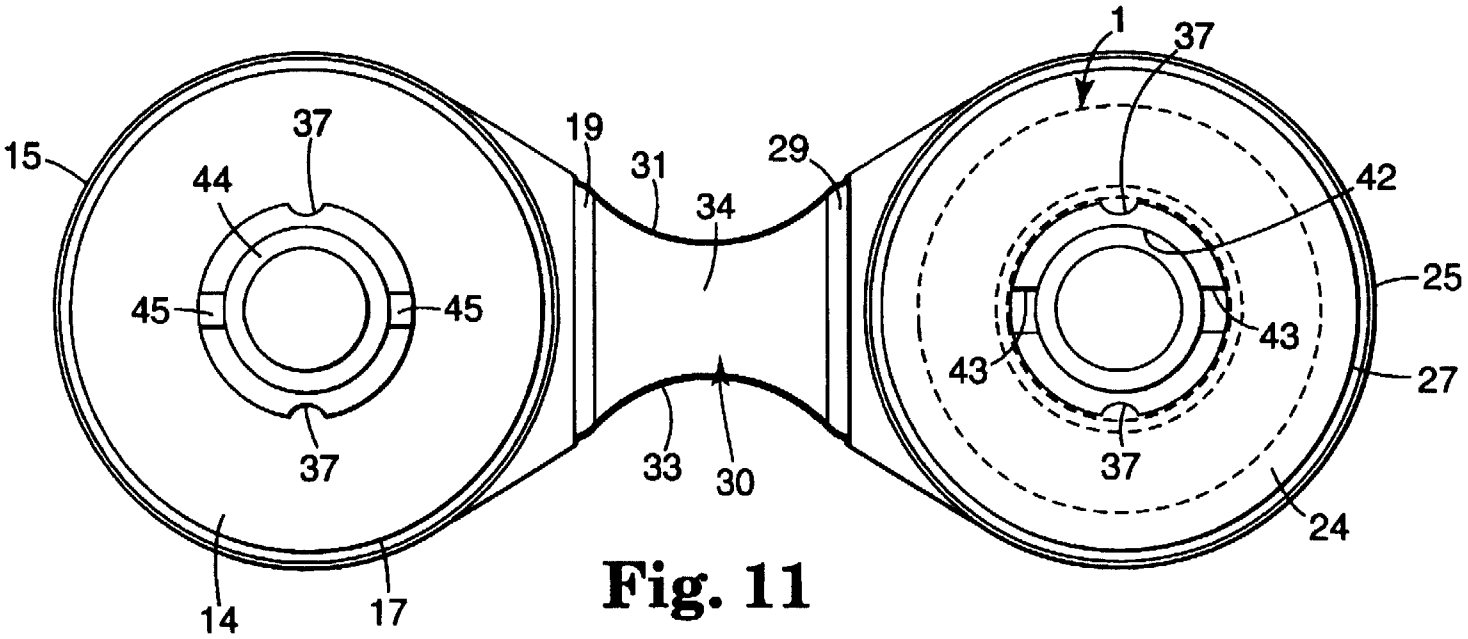
FIG. 11 is a top view of the protector and roll of tape of FIG. 10.

The protector 12 also has a second side portion comprising a second side wall 24 adapted to be placed substantially opposite the first side wall 14 (as shown in FIG. 3). The second side wall 24 has an outer periphery 25. Preferably, the outer periphery has a substantially circular portion defining an outer diameter OD2 which is at least as large as the outer diameter D of the roll of tape 1 so that the first side wall 14 completely covers the roll of tape 1, as opposed to some prior art tape dispensers which leave a portion of the roll of tape (e.g. portions of its side or edge) exposed to potential damage or contamination. As best seen in FIG. 11, the outer periphery 15 of the first side wall 14 is preferably substantially the same shape as the outer periphery 25 of the second side wall 24. Also preferably, the diameter OD1 of the first side wall is approximately equal to the diameter OD2 of the second side wall. As an example not intended to be limiting, the diameters OD1 and OD2 may be approximately 2 and 5/16 inches. Preferably, the second side portion has a strengthening boss or rib 27.

Figure 5:
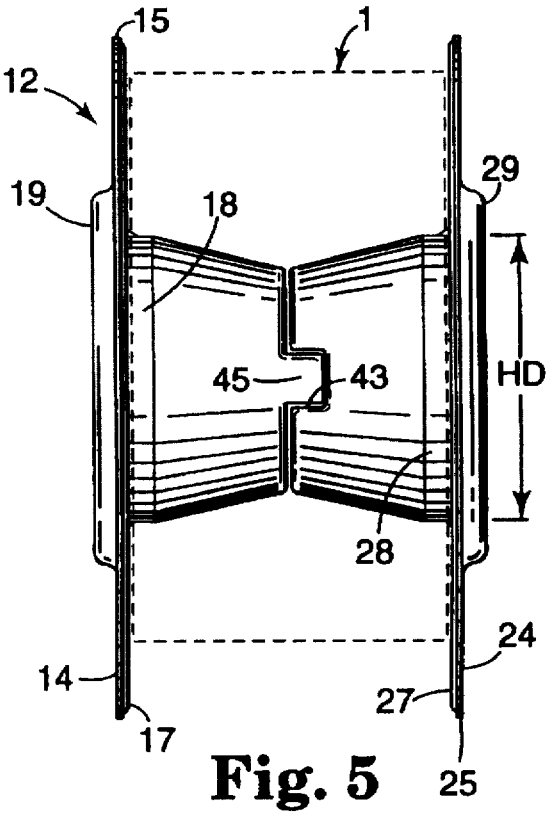
FIG. 5 is a rear view of the protector of FIG. 3 which illustrates the position of the roll of tape with dashed lines.

The second side portion also has a second hub portion 28. The protector 12 includes a releasable hub means for releasably attaching the first hub portion 18 to the second hub portion 28 to form a hub adapted to receive the roll of tape 1. The hub has an axis A and an outer hub diameter HD (FIG. 5). Preferably, the outer hub diameter HD is sized and shaped to afford free rotation of the roll of tape 1 about the hub. In particular, the outer hub diameter HD is less than the inner diameter ID of the core 8 of the roll of tape to afford free rotation of the roll of tape 1 about the hub. Optionally, but not preferably, the outer hub diameter HD may be approximately equal to the inner diameter ID of the core 8 of the roll of tape to fixedly attach the protector 12 relative to the roll of tape.

The hub is adapted to receive the roll of tape in one of either a) a first orientation which affords clockwise rotation of the roll of tape 1 about the axis of the hub, or b) a second orientation which affords counterclockwise rotation of the roll of tape about the axis A of the hub. The protector 12 is preferably universal in that the protector 12 functions the same regardless of whether the roll of tape 1 is in the first or the second orientation.

The protector 12 has a transverse, peripheral bridge portion 30 extending between the outer peripheries 15 and 25 of the first and second side walls. The peripheral bridge portion 30 has a pair of edges 31 and 33 and a tape anchoring surface 34 extending therebetween. The tape anchoring surface 34 is sized and shaped to have the leading end portion 9 of the tape adhered thereto when the roll of tape is mounted in either the first or the second orientation. The tape anchoring surface 34 is spaced from the outer peripheral surface 7 of the roll of tape to aid the user in identifying the location of the leading end 10 of the tape.

Preferably, the edges 31 and 33 are opposite arcuate edges. More preferably, the edges 31 and 33 are mirror images of each other to contribute to the universal feature of the protector 12. The universal feature of the protector 12 adds a degree of convenience to the function of the protector 12.

In order to enhance the user's access to the outer peripheral portion 7 of the roll of tape 1, the outer peripheries 15 and 25 of the first and second side walls are free of any portions extending therebetween other than the peripheral bridge portion 30 to provide an opening. A user may place his or her finger in the opening and between the first and second walls 14 and 24 to obtain easy access to the outer peripheral surface 7 of the roll of tape.

The opposite arcuate edges 31 and 33 of the peripheral bridge portion 30 are sized and shaped to engage a user's digit to assist in removing the leading end portion 9 of the tape from the tape anchoring surface. As an example not intended to be limiting, the peripheral bridge portion 30 may have a width BW (FIG. 7) of about one and one-eighth inches and a minimum distance between the arcuate edges M (FIG. 4) of about 9/16 inches.

If a leading end portion 9 of the tape 1 is adhered to the tape anchoring surface 34, a user may place his or her finger through the opening between the outer peripheries 15 and 25 and run it along the outer peripheral portion of the tape 7 until it engages the leading end 10 of the tape and either the first or the second edge 31 and 33 (e.g. the edge 31 or 33 closest to the leading end 10 of the tape). The structure of the protector 12 allows the user to easily grasp the leading portion 9 of the tape and unwind a preselected portion of the tape from the roll 1. Once the preselected portion of the tape is unwound, the preselected portion of tape may be separated from the roll 1. To separate the preselected portion of tape, a user may adhere a portion of the tape to the tape anchoring surface 34 to assist the user in separating the preselected portion of tape from the rest of the roll 1. In this manner, the protector 12 assists the user in creating a tearing force to separate the preselected portion of tape. This operation may be repeated until all of the tape is used, at which time the roll of tape may be replace and the protector 12 reused.

Also preferably, the protector 12 is free of any teeth, cutting surfaces, blades, tearing edges, or serrations for cutting the tape. Such a cutting means may be unnecessary if the roll of tape comprises a manually tearable tape, or if the user prefers to use a separate, independent cutting means such as a pair of scissors. As a result of the lack of a cutting means, the protector 12 may be conveniently handled without concern for the protector 12 scratching or otherwise damaging a surface. The protector 12 can be readily stored in and removed from the pocket of a user's clothing without concern for damage to the clothing. Additionally, the lack of a cutting means provides a dispenser which is relatively inexpensive, and free of complex cutting surfaces which may require careful monitoring during manufacture.

The protector 12 is constructed from an inexpensive, plastic material. The protector 12 is preferably, constructed from a plastic material selected from the group consisting of polystyrene, polyethylene, polypropylene and polycarbonate. Preferably, the protector is a one-piece or "integral" part which promotes ease of assembly and construction, and inventory simplification and reduction. Any suitable construction technique may be utilized to create the protector 12, including, but not limited to vacuum forming, pressure forming or injection molding. As an example not intended to be limiting, the protector 12 may be constructed from thermoformed, high impact polystyrene (0.03 inch THK DOW #484, with 15%–20% regrind).

The releasable hub means preferably comprises one of the first and second hub portions 18 and 28 having a socket portion 42 and the other of the first and second hub portions having a protruding portion 44 adapted to be received in the socket portion 42 in an interference or snap-fit. Optionally, the protruding portion 44 and socket 42 may have reverse tapers which, in cooperation with an interference fit, serve to bias the hub portions toward a locked or closed position.

The protector 12 further includes stabilizing means for restricting rotation of the first side portion relative to the second side portion. Preferably, the stabilizing means comprises one of the first and second hub portions having a key 45 and the other of the first and second hub portions having surfaces defining a slot 43 adapted to accept the key 45 when the releasable hub means forms the hub. The key 45 and slot 43 are situated to resist rotation of the first side portion relative to the second side portion. Optionally, strengthening indents 37 may be present on the hub to add strength to the protector 12.

Figure 4:
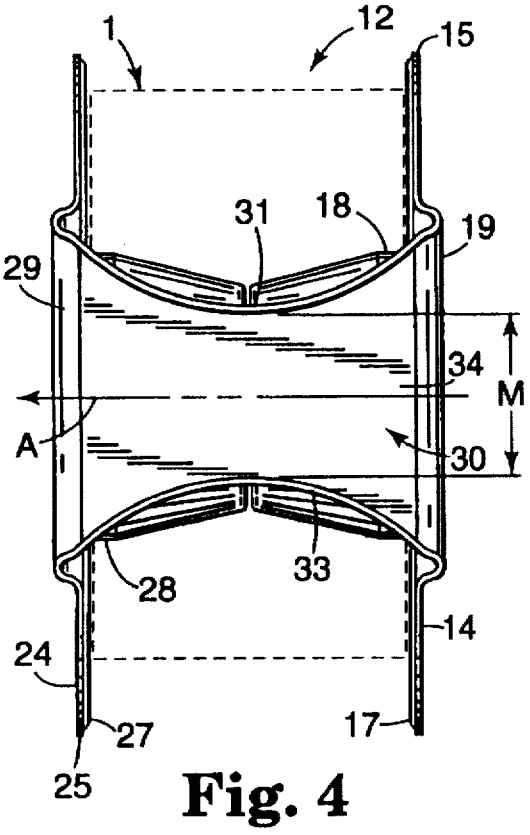
FIG. 4 is a front view of the protector of FIG. 3 which illustrates the position of the roll of tape with dashed lines.
Figure 7:
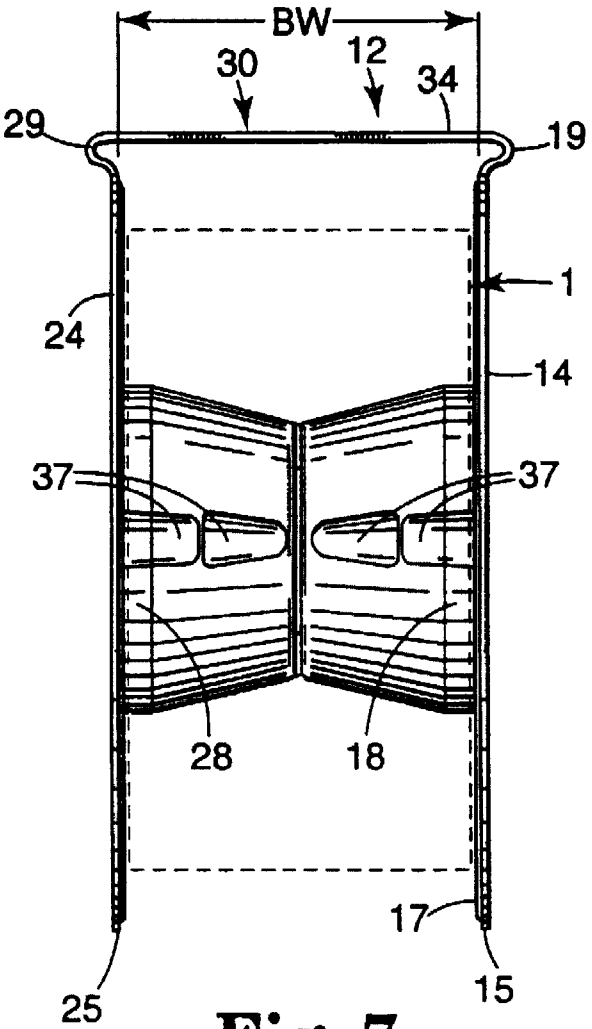
FIG. 7 is a bottom view of the protector of FIG. 3 with dashed lines illustrating the portion of the roll of tape mounted on a hub in the protector which is formed by first and second hub portions attached together.
Figure 6:
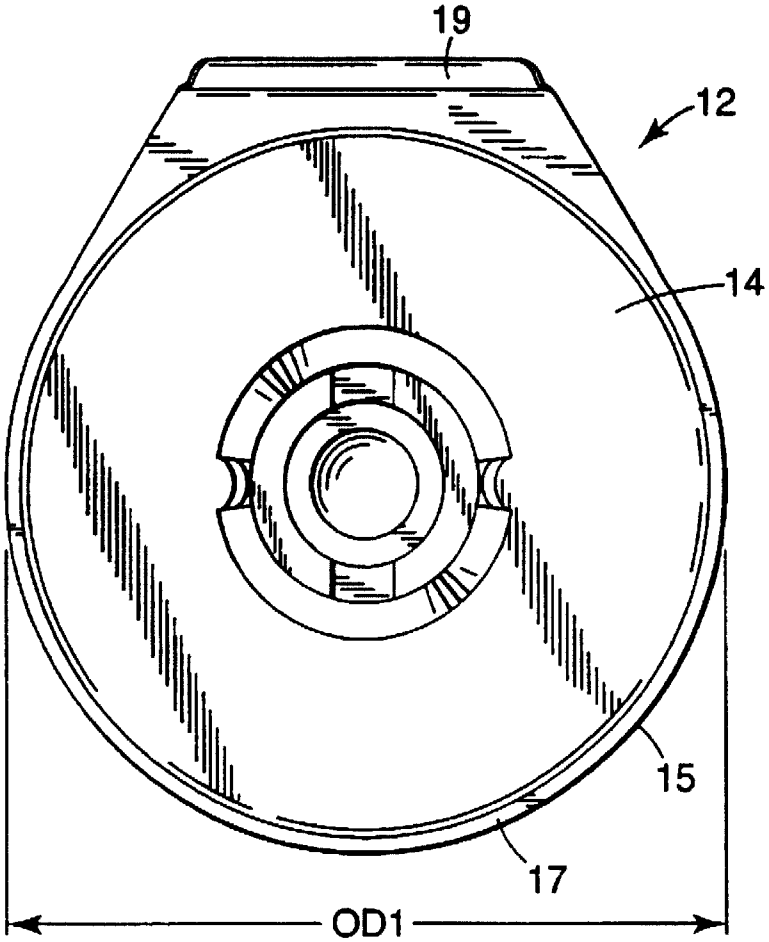
FIG. 6 is a side view of the protector of FIG. 3.
Figure 8:
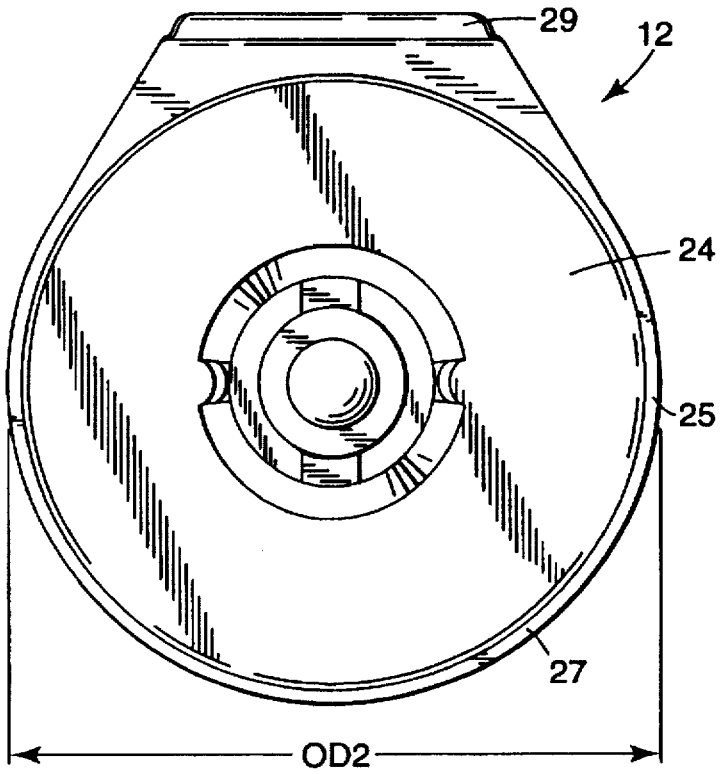
FIG. 8 is a side view of the protector of FIG. 3 which is opposite the side of FIG. 6.
Figure 9:
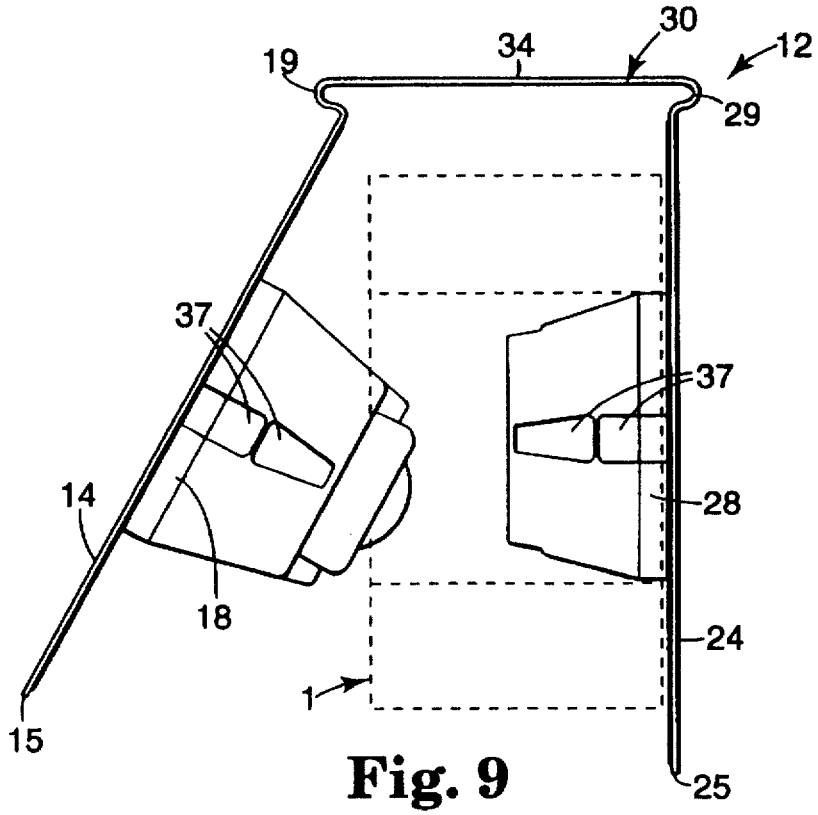
FIG. 9 is a top view of the protector illustrating first and second hub portions released in a partially open or core accept position and with a roll of tape illustrated with dashed lines.
Figure 10:
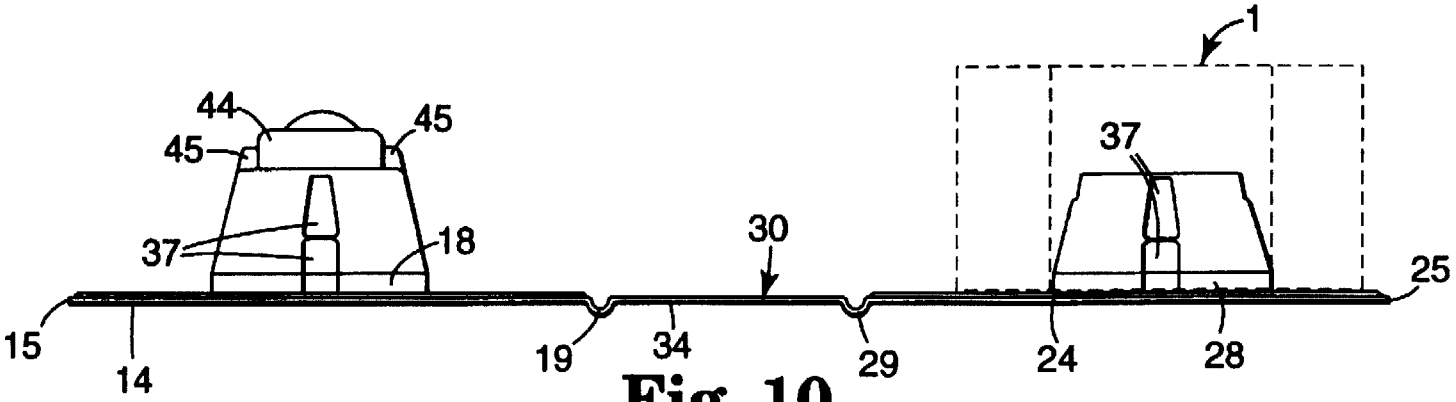
FIG. 10 illustrates side view a one-piece, integral element which may be utilized to provide the protector according to the present invention with a roll of tape illustrated with dashed lines.

The protector preferably includes a first hinge 19 between the bridge portion 30 and the first side portion and a second hinge 29 between the bridge portion 30 and the second side portion. The first and second hinges 19 and 29 afford movement of the releasable hub means between: (1) a core accept position (e.g. FIGS. 10 and 11) and (2) a hub position (FIGS. 4, 5 and 7). In the core accept position, the first hub portion is spaced from the second hub portion to afford removal or replacement of a roll of tape 1. In the hub position, the first hub portion is attached to the second hub portion to form the hub.

Method

The present invention also may be viewed as a method of protecting a roll of tape 1. The method comprises the steps of: 1) providing a protector 12 comprising: i) a first side portion comprising a first side wall 14 having an outer periphery 15, and a first hub portion 18, ii) a second side portion comprising a second side wall 24 having an outer periphery 25, and a second hub portion 28, and iii) a transverse, peripheral bridge portion 30 extending between the outer peripheries 15 and 25 of the first and second side walls. The peripheral bridge portion 30 has a pair of opposite edges 31 and 33 and a tape anchoring surface 34 extending therebetween. The tape anchoring surface 34 is sized and shaped to have a leading end portion 9 of the tape adhered thereto. The outer peripheries 15 and 25 of the first and second side walls are free of any portions extending therebetween other than the peripheral bridge portion 30 to provide an opening for access to the outer peripheral surface 7 of the roll of tape. The protector 12 is free of any teeth or serrations for cutting the tape.

Another step of the method comprises: placing the roll of tape 1 between the first and second hub portions 18 and 28. Next, the method comprises 3) releasably attaching the first hub portion 18 to the second hub portion 28 with the roll of tape 1 therebetween to form a hub which receives the core 8 of the roll of tape 1.

Preferably, the step of releasably attaching the first hub portion 18 to the second hub portion 28 comprises the step of: providing a hub having an axis and an outer hub diameter that is sized and shaped to afford free rotation of the roll of tape about the hub, the hub being adapted to receive the roll of tape 1 in one of either a) a first orientation which affords clockwise rotation of the roll of tape about the axis of the hub, or b) a second orientation which affords counterclockwise rotation of the roll of tape 1 about the axis of the hub.

The present invention has now been described with reference to several embodiments thereof. It will be apparent to those skilled in the art that many insubstantial changes or additions can be made in the embodiments described without departing from the scope of the present invention. Thus, the scope of the present invention should not be limited to the structures described in this application, but only by structures described by the language of the claims and the equivalents of those structures.

What is claimed is:

1. A one-piece protector for a roll of tape having a leading end portion of tape, a pair of sides and edges, a width, an outer peripheral surface defining an outer diameter, and a core defining an inner diameter; said protector comprising:

a first side portion comprising a first side wall having an outer periphery with a substantially circular portion defining an outer diameter which is at least as large as the outer diameter of the roll of tape, and a first hub portion;

a second side portion comprising a second side wall adapted to be placed substantially opposite said first side wall, said second side wall having an outer periphery having a substantially circular portion defining an outer diameter which is at least as large as the outer diameter of the roll of tape, and a second hub portion;

releasable hub means for releasably attaching said first hub portion to said second hub portion to form a hub adapted to receive the roll of tape, said hub having an axis and an outer hub diameter that is sized and shaped to afford free rotation of the roll of tape about the hub, said hub being adapted to receive the roll of tape in one of either a) a first orientation which affords clockwise rotation of the roll of tape about the axis of the hub, or b) a second orientation which affords counterclockwise rotation of the roll of tape about the axis of the hub, a transverse, peripheral bridge portion extending between outer peripheries of said first and second side walls, said peripheral bridge portion having a pair of edges and a tape anchoring surface extending therebetween, said tape anchoring surface being sized and shaped to have the leading end portion of the tape adhered thereto when the roll of tape is mounted in either the first or the second orientation;

wherein the outer peripheries of said first and second side walls are free of any portions extending therebetween other than said peripheral bridge portion to provide an opening for access to the outer peripheral surface of the roll of tape; and wherein the protector is free of any teeth or serrations for cutting the tape.

2. A protector according to claim 1 wherein the outer periphery of said first side wall is substantially the same shape as the outer periphery of the second side wall, and the diameter of the first side wall is approximately equal to the diameter of the second side wall.

3. A protector according to claim 1 wherein said outer hub diameter is less than the inner diameter of the core of the roll of tape to afford free rotation of the roll of tape about said hub.

4. A protector according to claim 1 wherein the protector is constructed from a plastic material selected from the group consisting of polystyrene, polyethylene, polypropylene and polycarbonate.

5. A protector according to claim 1 wherein said releasable hub means comprises one of said first and second hub portions having a socket portion and the other of said first and second hub portions having a protruding portion adapted to be received in said socket portion in an interference fit.

6. A protector according to claim 5 wherein the protector further includes stabilizing means for restricting rotation of said first side portion relative to said second side portion.

7. A protector according to claim 6 wherein said stabilizing means comprises one of said first and second hub portions having a key and the other of said first and second hub portions having a slot adapted to receive the key when the releasable hub means forms said hub, said key and slot being situated to resist rotation of said first side portion relative to said second side portion.

8. A protector according to claim 1 wherein said edges of said peripheral bridge portion are opposite arcuate edges that are sized and shaped to engage a user's digit to assist a user in removing the leading end portion of the tape from the tape anchoring surface.

9. A protector according to claim 8 wherein the peripheral bridge portion has a width of about one and one-eighths inches and a minimum distance between the arcuate edges of about 9/16 inches.

10. A protector according to claim 1 wherein said protector includes a first hinge between the bridge portion and the first side portion and a second hinge between the bridge portion and the second side portion, said first and second hinges affording movement of said releasable hub means between a core accept position with the first hub portion spaced from said second hub portion to afford removal or replacement of a roll of tape and a hub position with the first hub portion attached to the second hub portion to form the hub.

11. A method of protecting a roll of tape having a leading end portion of tape, a pair of sides and edges, a width, an outer peripheral surface defining an outer diameter, and a core defining an inner diameter; the method comprising the steps of:

a) providing a protector comprising:

i) a first side portion comprising a first side wall having an outer periphery, and a first hub portion, ii) a second side portion comprising a second side wall having an outer periphery, and a second hub portion, and iii) a transverse, peripheral bridge portion extending between the outer peripheries of said first and second side walls, said peripheral bridge portion having a pair of opposite edges and a tape anchoring surface extending therebetween, the tape anchoring surface being sized and shaped to have the leading end portion of the tape adhered thereto, the outer peripheries of said first and second side walls being free of any portions extending therebetween other than said peripheral bridge portion to provide an opening for access to the outer peripheral surface of the roll of tape, and with the protector being free of any teeth or serrations for cutting the tape;

b) placing the roll of tape between the first and second hub portions with the roll of tape therebetween; and c) releasably attaching the first hub portion to the second hub portion to form a hub which receives the roll of tape.

12. A method according to claim 11 wherein the step of releasably attaching the first hub portion to the second hub portion comprises the step of providing a hub having an axis and an outer hub diameter that is sized and shaped to afford free rotation of the roll of tape about the hub, the hub being adapted to receive the roll of tape in one of either a) a first orientation which affords clockwise rotation of the roll of tape about the axis of the hub, or b) a second orientation which affords counterclockwise rotation of the roll of tape about the axis of the hub.

13. A protector for a roll of hand tearable, medical tape having a leading end portion of tape, a pair of sides and edges, a width, an outer peripheral surface defining an outer diameter, and a core defining an inner diameter, said protector comprising:

a first side portion comprising a first side wall having an outer periphery with a substantially circular portion defining an outer diameter which is at least as large as the outer diameter of the roll of tape, and a first hub portion;

a second side portion comprising a second side wall adapted to be placed substantially opposite said first side wall, said second side wall having an outer periphery having a substantially circular portion defining an outer diameter which is at least as large as the outer diameter of the roll of tape, and a second hub portion;

releasable hub means for releasably attaching said first hub portion to said second hub portion to form a hub adapted to receive the roll of tape, said hub having an axis and an outer hub diameter that is sized and shaped to afford free rotation of the roll of tape about the hub, said hub being adapted to receive the roll of tape in one of either a) a first orientation which affords clockwise rotation of the roll of tape about the axis of the hub, or b) a second orientation which affords counterclockwise rotation of the roll of tape about the axis of the hub, a transverse, peripheral bridge portion extending between outer peripheries of said first and second side walls, said peripheral bridge portion having a pair of edges and a tape anchoring surface extending therebetween, said tape anchoring surface being sized and shaped to have the leading end portion of the tape adhered thereto when the roll of tape is mounted in either the first or the second orientation; and wherein the outer peripheries of said first and second side walls are free of any portions extending therebetween other than said peripheral bridge portion to provide an opening for access to the outer peripheral surface of the roll of tape.

14. A protector according to claim 13 wherein the outer periphery of said first side wall is substantially the same shape as the outer periphery of the second side wall, and the diameter of the first side wall is approximately equal to the diameter of the second side wall.

15. A protector according to claim 13 wherein the protector is free of any teeth or serrations for cutting the tape.

16. A protector according to claim 1 wherein said outer hub diameter is less than the inner diameter of the core of the roll of tape to afford free rotation of the roll of tape about said hub.

17. A protector according to claim 13 wherein said releasable hub means comprises one of said first and second hub portions having a socket portion and the other of said first and second hub portions having a protruding portion adapted to be received in said socket portion in a snap-fit; and stabilizing means for restricting rotation of said first side portion relative to said second side portion.

18. A protector according to claim 17 wherein said stabilizing means comprises one of said first and second hub portions having a key and the other of said first and second hub portions having a slot adapted to receive the key when the releasable hub means forms said hub, said key and slot being situated to resist rotation of said first side portion relative to said second side portion.

19. A protector according to claim 13 wherein said edges of said peripheral bridge portion are opposite arcuate edges that are sized and shaped to engage a user's digit to assist a user in removing the leading end portion of the tape from the tape anchoring surface.

20. A protector according to claim 13 wherein said protector includes a first hinge between the bridge portion and the first side portion and a second hinge between the bridge portion and the second side portion, said first and second hinges affording movement of said releasable hub means between a core accept position with the first hub portion spaced from said second hub portion to afford removal or replacement of a roll of tape and a hub position with the first hub portion attached to the second hub portion to form the hub.

* * * * *